US010130859B1

(12) United States Patent
Riley

(10) Patent No.: US 10,130,859 B1
(45) Date of Patent: Nov. 20, 2018

(54) TRAINING DEVICE WITH RETURN

(71) Applicant: Russell Riley, Memphis, TN (US)

(72) Inventor: Russell Riley, Memphis, TN (US)

( * ) Notice: Subject to any disclaimer, the term of this patent is extended or adjusted under 35 U.S.C. 154(b) by 55 days.

(21) Appl. No.: 15/688,800

(22) Filed: Aug. 28, 2017

(51) Int. Cl.
*A63B 69/00* (2006.01)
*A63B 63/00* (2006.01)

(52) U.S. Cl.
CPC ..... *A63B 63/004* (2013.01); *A63B 63/003* (2013.01); *A63B 69/0097* (2013.01); *A63B 2063/001* (2013.01); *A63B 2063/002* (2013.01); *A63B 2210/50* (2013.01)

(58) Field of Classification Search
CPC .. A63B 63/004; A63B 63/003; A63B 69/0097
USPC ..... 473/446, 454–456, 476, 478; 273/394–402
See application file for complete search history.

(56) References Cited

U.S. PATENT DOCUMENTS 3,627,327 A 12/1971 White
4,129,916 A * 12/1978 Schlesinger ..... A63C 19/10 14/69.5
4,497,485 A 2/1985 Macasko
5,007,638 A 4/1991 Yulk
5,133,548 A 7/1992 Bedford et al.
6,209,877 B1 4/2001 Warnick
6,322,461 B1 11/2001 Walsh
6,739,988 B2 5/2004 Jensen et al.
7,252,604 B2 8/2007 Birss
7,543,821 B2 * 6/2009 Winningham ..... A63B 63/004 273/396
7,704,169 B1 * 4/2010 Bove ..... A63B 63/007 473/426
7,753,375 B1 7/2010 Neal et al.
7,828,296 B2 11/2010 Crawley et al.
8,590,901 B2 * 11/2013 Goldwitz ..... A63B 63/00 273/395
8,678,957 B1 * 3/2014 Essex ..... A63B 63/00 273/402
2002/0049103 A1 * 4/2002 Treihart ..... A63B 63/00 473/454
2009/0093325 A1 * 4/2009 Meltzer ..... A63B 63/06 473/454
2010/0081513 A1 * 4/2010 La Pointe ..... A63B 63/00 473/197

* cited by examiner

*Primary Examiner* — Nini Legesse
(74) *Attorney, Agent, or Firm* — David J. Kreher

(57) ABSTRACT

This disclosure presents a training device and return for practice or game play so that when a ball is directed toward the target, the ball can either impact the target face or pass through one of a plurality of holes in the target face. The training device may be adjustable for use with different sized balls and the return may be automated.

4 Claims, 3 Drawing Sheets

TRAINING DEVICE WITH RETURN

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

DESCRIPTION

Field of the Invention

This disclosure presents a training device with return for practice or game play so that when a ball is directed toward the training device with return, the ball can either impact the front sheet or pass through one of a plurality of holes in the front sheet. If the ball impacts the front sheet, the target face absorbs the impact and the ball falls from the target face. If the ball passes through one of the plurality of holes the ball, where the ball may include but is not limited to a golf ball, tennis ball, baseball, softball, volley ball, soccer ball, or basketball, impacts a back sheet capable of absorbing the impact of the ball, at which point the ball falls to the floor and rolls out from behind the front sheet.

The ball return is collapsible and portable as the legs of the ball return are hinges to allow them to be separated when the training device with return is set up and the legs can be brought together for transport. In addition, there are arms that are removable from the device for transport, and those arms may be extendible and retractable to adjust the different sized front and back sheets that can be attached.

Background of the Invention

Games and practice apparatus using a combination of a plurality of holes through which balls are projected have existed for a long of time. The present disclosure reveals an easily transportable version with a front sheet and back sheet that can be customized in design and size to accommodate different sized balls and multiple holes at which to aim.

SUMMARY OF THE INVENTION

This disclosure relates a training device with return for practice of game play comprising a support structure, a front face with a plurality of holes, and a back sheet. The support structure is collapsible and adjustable such that the arms are removable for transport and attachable to allow the training device with return to be set up. In addition, the legs of the structure can be brought together for transport or separated to set up the training device with return, and the positioning of the back leg can be adjusted to adjust the angle of the front sheet.

In order to prevent a ball from bouncing up or sideways once it passes through one of the holes in the front sheet of the training device with return, attached to the back of the front sheet above each hole is a flap that is larger than the hole so that the ball impacts the flap prior to encountering the back sheet.

Because the front sheet and back sheet are removable, the arms of the structure may be extendable and retractable to adjust for the size of the front sheet and back sheet that is attached to the training device with return.

AMENDED BRIEF DESCRIPTION OF THE SEVERAL VIEWS OF THE INVENTION

DETAILED DESCRIPTION OF THE INVENTION

Figure 1:
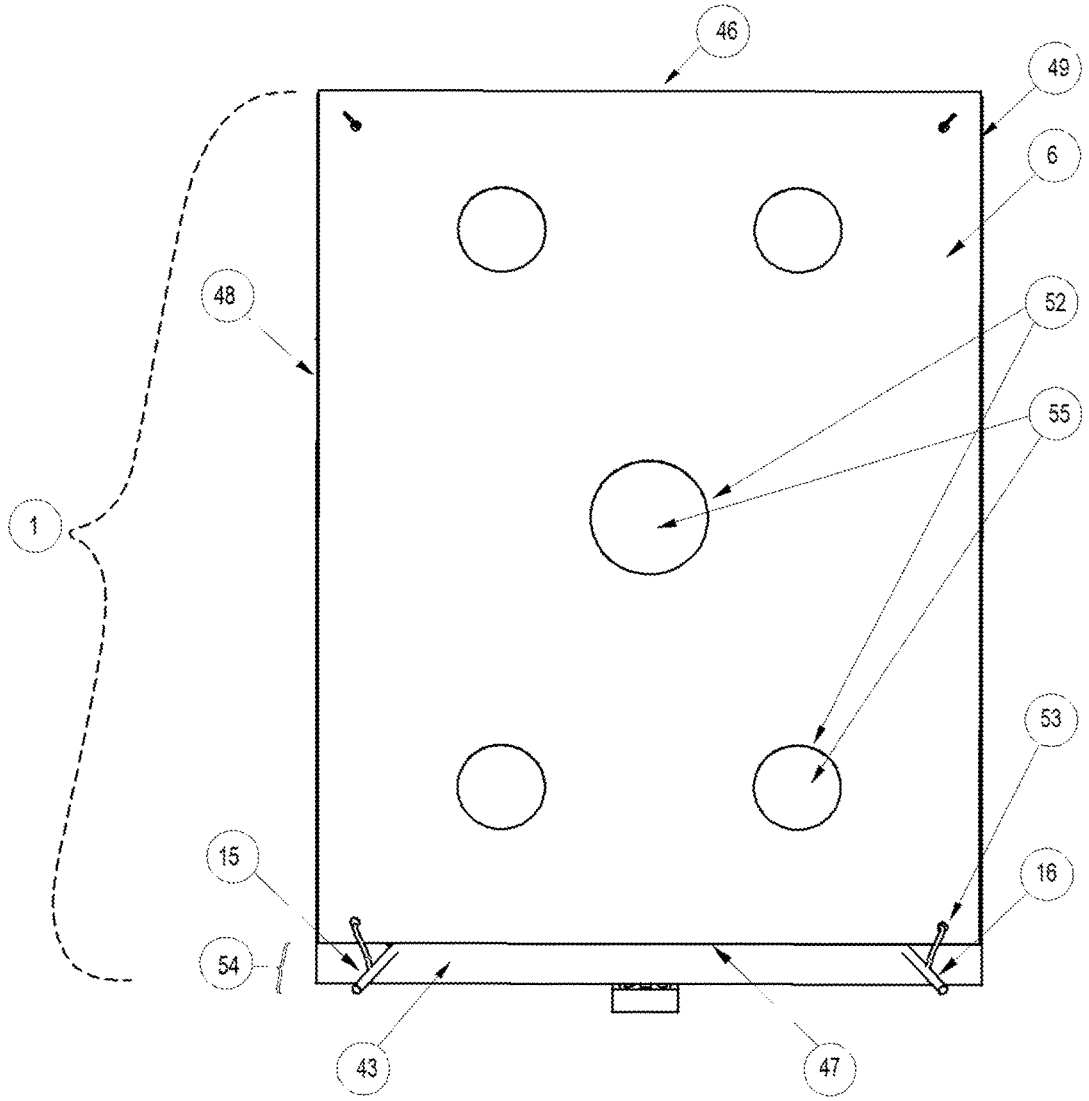
FIG. 1 is a front view of the training device with return.
Figure 2:
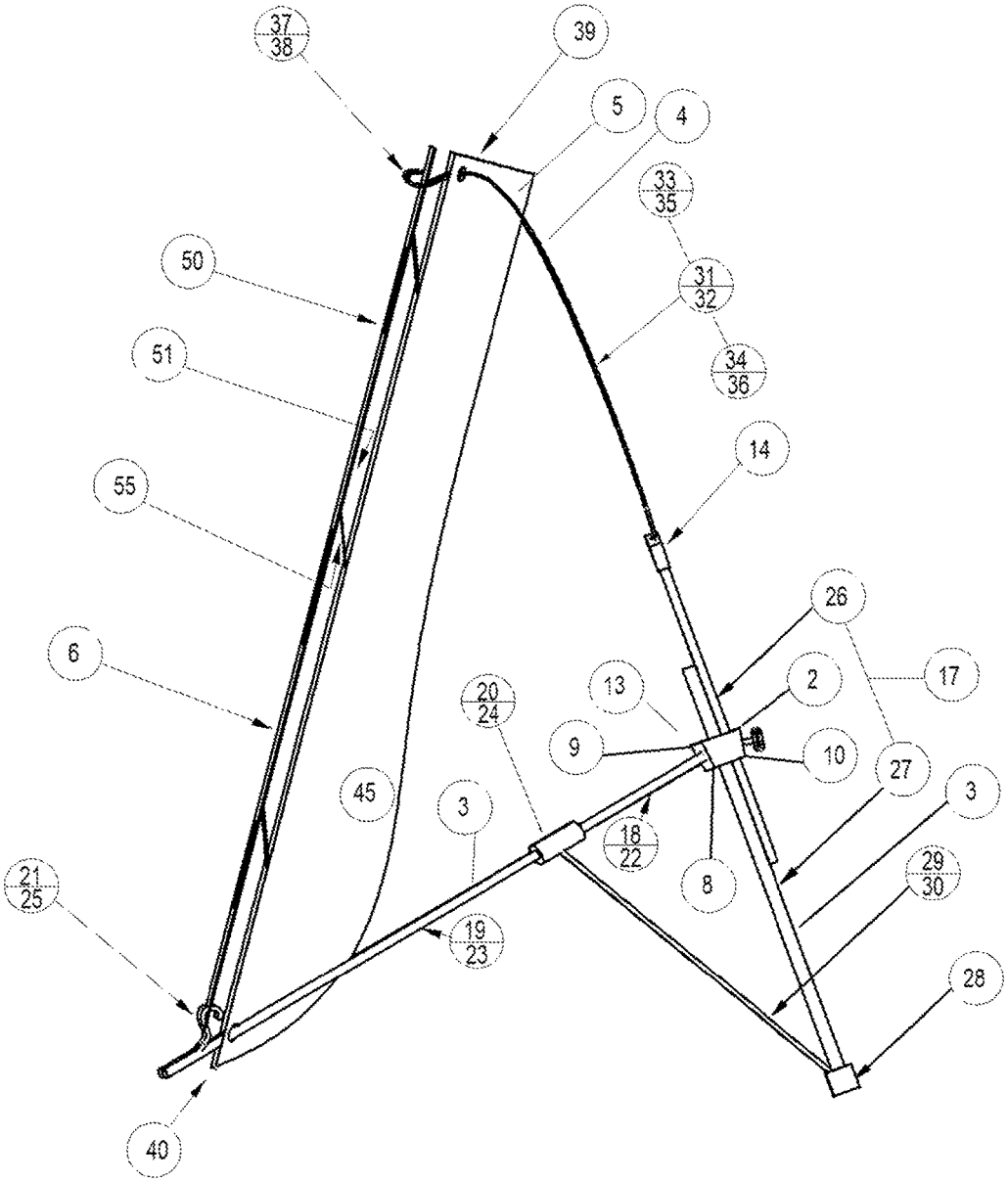
FIG. 2 is a side view of the training device with return.
Figure 3:
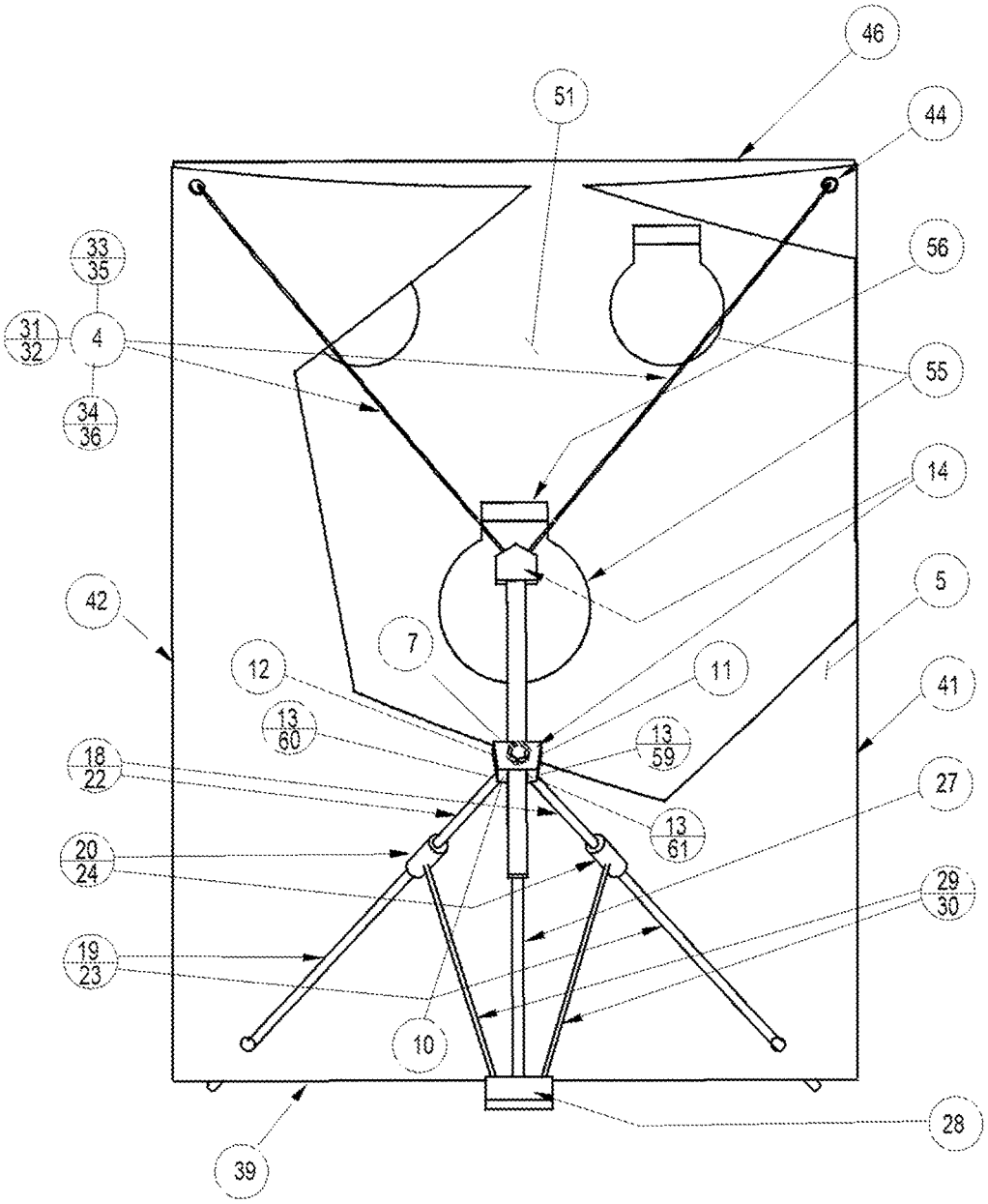
FIG. 3 is a view of the training device from the back, wherein there is a cut-away of the back sheet to display the front sheet relative to the back sheet and so that the flaps attached to the front sheet of the training device are visible.

The present disclosure reveals training device with return 1 for practice and game play comprising a base 2, a plurality of legs 3, a plurality of arms 4, a back sheet 5, and a front sheet 6. The base 2 comprises a top 7, a bottom 8, a front 9, a back 10, a left side 11, a right side 12, a plurality of attachments 13, and a plurality of receivers 14. The plurality of attachments 13 are attached to the base 2, connect each of the plurality of legs to the base, facilitate each of the plurality of legs 3 to pivot at the base 2, and may include but not be limited to a cotter pin, threaded fastener, or rod. Each attachment 13 of the plurality of attachments 13 is capable of allowing each leg of the plurality of legs to pivot. The plurality of receivers 14 may include holes or sleeves into which an arm of the plurality of arms is inserted. Each receiver 14 of the plurality of receivers 14 being capable of having an arm inserted into it.

The plurality of legs 3 comprise a left front leg 15, a right front leg 16, and a back leg 17. The left front leg 15 comprises an upper portion 18, a lower portion 19, and a left stabilizer connection 20. The upper portion 18 of the left front leg 15 is attached to the bottom 8 left side 11 front 9 portion of the base 2 by a first attachment 13, 59 of the plurality of attachments 13. The left front leg 15 further comprises a left leg connector 21 extending from the lower portion 19. The right front leg 16 comprises an upper portion 22, a lower portion 23, and a right stabilizer connection 24. The upper portion 22 of the right front leg 16 is attached to the bottom 8 right side 12 front 9 portion of the base 2 by a second attachment 13, 60 of the plurality of attachments 13. The right front leg 16 further comprises a right leg connector 25 extending from the lower portion 23. The back leg 17 comprises an upper portion 26, a lower portion 27, and a back stabilizer connection 28. The upper portion 26 of the back leg 17 is attached to the bottom 8 back 10 portion of the base 8 by a third attachment 13, 61 of the plurality of attachments 13.

There is a left stabilizer 29 that extends from the back stabilizer connection 28 to the left stabilizer connection 20 and a right stabilizer 30 that extends from the back stabilizer connection 28 to the right stabilizer connection 24. The left stabilizer connection 20, the right stabilizer connection 24, and the back stabilizer connection 28 are adjustable such that as the left front leg 15, the right front leg 16, and the back leg 17 are pivoted at the base, each of the left stabilizer connection 20 and the right stabilizer connection 24 adjust position and the left stabilizer 29 and the right stabilizer pivot at the back stabilizer connection 28. Each of the left stabilizer connection 20 and the right stabilizer connection 24 can be locked into place when the positions of the left front leg 15, right front leg 16, and back leg 17 have been established.

The plurality of arms 4 comprises a left arm 31 and a right arm 32 that are flexible. The left arm 31 comprises an upper portion 33 and a lower portion 34. The right arm 32 comprises an upper portion 35 and a lower portion 36. The lower portion 34 of the left arm 31 is inserted into a left receiver 14 of the plurality of receivers 14 when the training device with return 1 is set up and removable from the left receiver 14 to take down the training device with return 1 and wherein lower portion 34 of the right arm 32 is inserted into a right receiver 14 of the plurality of receivers 14 when the training device with return 1 is set up and removable from the right receiver 14 to take down the training device with return 1. The left arm 31 further comprises a left arm connector 37 extending from the upper portion 33. The right arm 32 further comprises a right arm connector 38 extending from the upper portion 35. The left arm connector 37 and right arm connecter 38 can be but is not limited to a hook, latch, or coupling.

The back sheet 5 comprises a top edge 39, bottom edge 40, left edge 41, right edge 42, face 43, and a plurality of back sheet receivers 44. The each of the back sheet receiver 44 of the plurality of back sheet receivers 44 can be but is not limited to a grommet, bolt, or loop. There is a first back sheet receiver 44 of the plurality of back sheet receivers 44 in the area of the intersection of the left edge 41 and top edge 39 and a second back sheet receiver 44 of the plurality of back sheet receivers 44 in the area of the intersection of the right edge 42 and top edge 39. When the training device with return 1 is set up first back sheet receiver 44 is attached to the left arm connector 37 and the second back sheet receiver 44 is connected to the right arm connector 38. The back sheet 5 further comprises a length 45 that extends from the top edge 39 to the bottom edge 40 such that when the back sheet 5 is attached to the left arm 31 and the right arm 32 the back sheet 5 extends down to the floor between the back leg 17 and the left front leg 15 and right front leg 16 and extends such that the bottom edge 40 is positioned past the left front leg 15 and right front leg 16.

The front sheet 6 comprises a top edge 46, bottom edge 47, left edge 48, right edge 49, face 50, a back 51, a plurality of holes 52, and a plurality of front sheet receivers 53. The front sheet receiver 53 can be but is not limited to a grommet, bolt, or loop. There is a first front sheet receiver 53 of the plurality of front sheet receivers 53 in the area of the intersection of the left edge 48 and top edge 46, a second front sheet receiver 53 of the plurality of front sheet receivers 53 in the area of the intersection of the right edge 49 and top edge 46, there is a third front sheet receiver 53 of the plurality of front sheet receivers 53 in the area of the intersection of the left edge 48 and bottom edge 47, and a fourth front sheet receiver 53 of the plurality of front sheet receivers 53 in the area of the intersection of the right edge 49 and bottom edge 47. When the training device with return 1 is set up the first front sheet receiver 53 is attached to the left arm connector 37, the second front sheet receiver 53 is connected to the right arm connector 38, the third front sheet receiver 53 is attached to the front left leg connector 21, and the fourth front sheet receiver 53 is connected to the front right leg connector 25. When the front sheet 6 is attached as described the front sheet 6 does not wrinkle or sag and when the front sheet 6 is attached as described there is a gap 54 between the bottom edge 47 of the front sheet 6 and the back sheet 5 that allows a ball to pass below the bottom edge 47 of the front sheet 6 without contacting the bottom edge 47 of the front sheet 6.

In a second embodiment of the training device with return 1 the front sheet 6 further comprises a plurality of flaps 55 equal to the number of holes 52 of the plurality of holes 52. The plurality of flaps 55 comprise a top edge 56 and a front 57, each flap 55 of the plurality of flaps 55 is larger than the hole 52 of the plurality of holes 52 behind which each flap 55 is positioned. Each flap 55 of the plurality of flaps 55 is attached to the back 51 of the front sheet 6 such that the top edge 56 of the flap 55 is attached to the back 51 of the front sheet 6 above the hole 52 the flap 55 is to cover such that, when a ball passes through the hole 52 the ball impacts the flap 55 and then the back sheet 5.

In either of the above embodiments, the plurality of arms 4 can be collapsible and extendable to adjust for the size of the front sheet 6 and back sheet 5 that are being attached.

What is claimed:

1. A training device with return for practice and game play comprising:

a base, a plurality of legs, a plurality of arms, a back sheet, and a front sheet;

the base comprising a top, a bottom a front a back a left side, and a right side, a plurality of attachments, and a plurality of receivers;

each attachment of the plurality of attachments is attached to the base, connects each leg of the plurality of legs to the base, facilitate each leg of the plurality of legs to pivot at the base, and the plurality of attachments comprising at least one of a cotter pin, threaded fastener, or rod;

each attachment of the plurality of attachments being capable of allowing that leg of the plurality of legs to which the attachment is attached to pivot;

each receiver of the plurality of receivers being capable of having an arm of the plurality of arms inserted into it;

the plurality of legs comprising a left front leg, a right front leg and a back leg;

the left front leg comprising an upper portion, a lower portion, and a left stabilizer connection;

the upper portion of the left front leg being attached to the bottom left front portion of the base by a first attachment of the plurality of attachments;

the left front leg further comprising a left leg connector extending from the lower portion;

the right front leg comprising an upper portion, a lower portion, and a right stabilizer connection;

the upper portion of the right front leg being attached to the bottom right front portion of the base by a second attachment of the plurality of attachments;

the right front leg further comprising a right leg connector extending from the lower portion;

the back leg comprising an upper portion, a lower portion, and a back stabilizer connection;

the upper portion of the back leg being attached to the bottom back portion of the base by a third attachment of the plurality of attachments;

wherein there is a left stabilizer that extends from the back stabilizer connection to the left stabilizer connection, a right stabilizer that extends from the back stabilizer connection to the right stabilizer connection, and wherein the left stabilizer connection, the right stabilizer connection, and the back stabilizer connection are adjustable such that as the left front leg, the right front leg, and the back leg are pivoted at the base, each of the left stabilizer connection and the right stabilizer connection adjust position and the left stabilizer and the right stabilizer pivot at the back stabilizer connection; wherein each of the left stabilizer connection and the right stabilizer connection are locked into place when the position of the left front leg, right front leg and back leg has been established;

a plurality of arms comprising a left arm and a right arm;

the left arm comprising an upper portion and a lower portion;

the right arm comprising an upper portion and a lower portion;

wherein the left arm and right arm are flexible;

wherein the lower portion of the left arm is inserted into a left receiver of the plurality of receivers when the training device with return is set up and removable from the left receiver to take down the training device with return and wherein lower portion of the right arm is inserted into a right receiver of the plurality of receivers when the training device with return is set up and removable from the right receiver to take down the training device with return;

wherein the left arm further comprising a left arm connector extending from the upper portion;

wherein the right arm further comprising a right arm connector extending from the upper portion;

the back sheet comprises a top edge, bottom edge, left edge, right edge, face, and a plurality of back sheet receivers;

wherein there is a first back sheet receiver of the plurality of back sheet receivers in the area of the intersection of the left edge and top edge and a second back sheet receiver of the plurality of back sheet receivers in the area of the intersection of the right edge and top edge;

wherein, when the training device with return is set up first back sheet receiver is attached to the left arm connector and the second back sheet receiver is connected to the right arm connector;

wherein the back sheet further comprises a length that extends from the top edge to the bottom edge such that when the back sheet is attached to the left arm and the right arm the back sheet extends down to the floor between the back leg and the left front leg and right front leg and extends such that the bottom edge is positioned past the left front leg and right front leg;

the front sheet comprises a top edge, bottom edge, left edge, right edge, face, a back, a plurality of holes, and a plurality of front sheet receivers;

wherein there is a first front sheet receiver of the plurality of front sheet receivers in the area of the intersection of the left edge and top edge, a second front sheet receiver of the plurality of front sheet receivers in the area of the intersection of the right edge and top edge, there is a third front sheet receiver of the plurality of front sheet receivers in the area of the intersection of the left edge and bottom edge, and a fourth front sheet receiver of the plurality of front sheet receivers in the area of the intersection of the right edge and bottom edge;

wherein, when the training device with return is set up the first front sheet receiver is attached to the left arm connector, the second front sheet receiver is connected to the right arm connector, the third front sheet receiver is attached to the front left leg connector, and the fourth front sheet receiver is connected to the front right leg connector;

when the front sheet is attached as described the front sheet does not wrinkle or sag; and when the front sheet is attached as described there is a gap between the bottom edge of the front sheet and the back sheet that allows a ball to pass below the bottom edge of the front sheet without contacting the bottom edge of the front sheet.

2. The training device with return of claim 1 wherein the front sheet further comprises a plurality of flaps equal to the number of hole of the plurality of holes;

the plurality of flaps comprise a top edge and a front, each flap of the plurality of flaps is larger than the hole of the plurality of holes behind which each flap is positioned; and each flap of the plurality of flaps is attached to the back of the front sheet such that the top edge of the flap is attached to the back of the front sheet above the hole the flap is to cover such that, when a ball passes through the hole the ball impacts the flap and then the back sheet.

3. The training device with return of claim 1 wherein the plurality of arms are collapsible and extendable to adjust for the size of the front sheet and back sheet that are being attached.

4. The training device with return of claim 1 wherein the front sheet further comprises a plurality of flaps equal to the number of hole of the plurality of holes;

the plurality of flaps comprise a top edge and a front, each flap of the plurality of flaps is larger than the hole of the plurality of holes behind which each flap is positioned; and each flap of the plurality of flaps is attached to the back of the front sheet such that the top edge of the flap is attached to the back of the front sheet above the hole the flap is to cover such that, when a ball passes through the hole the ball impacts the flap and then the back sheet.

* * * * *